US005487872A

United States Patent [19]

Hafeman et al.

[11] Patent Number: 5,487,872

[45] Date of Patent: Jan. 30, 1996

[54] ULTRAVIOLET RADIATION TRANSPARENT MULTI-ASSAY PLATES

[75] Inventors: Dean G. Hafeman, Hillsborough; Gillian M. K. Humphries, Los Altos, both of Calif.

[73] Assignee: Molecular Device Corporation, Sunnyvale, Calif.

[21] Appl. No.: 228,415

[22] Filed: Apr. 15, 1994

[51] Int. Cl.[6] ..... B01L 3/00; B01L 11/00

[52] U.S. Cl. ..... 422/102; 422/101; 435/288.4; 356/246; 356/440

[58] Field of Search ..... 422/102, 101, 422/104; 356/246, 440; 435/301, 300, 299, 801

[56] References Cited

U.S. PATENT DOCUMENTS

| | | | |
|---|---|---|---|
| 3,703,336 | 11/1972 | Rosse et al. | 356/39 |
| 4,797,259 | 1/1989 | Matkovich | 422/101 |
| 4,828,386 | 5/1989 | Matkovich et al. | 356/246 |
| 4,892,409 | 1/1990 | Smith | 356/414 |
| 4,968,148 | 11/1990 | Chow et al. | 356/427 |
| 5,047,215 | 9/1991 | Manns | 422/101 |
| 5,084,246 | 1/1992 | Lyman et al. | 422/101 |
| 5,110,556 | 5/1992 | Lyman et al. | 422/101 |
| 5,229,163 | 7/1993 | Fox | 427/2 |
| 5,319,436 | 7/1994 | Manns et al. | 356/246 |

*Primary Examiner*—Robert J. Warden
*Assistant Examiner*—N. Bhat
*Attorney, Agent, or Firm*—Banner & Allegretti, Ltd.

[57] ABSTRACT

An ultraviolet radiation transparent multi-assay plate for ultraviolet absorption spectroscopy of ultraviolet absorbing liquids comprising a plurality of cylinders fixed in a frame each covered at the bottom with a portion of an ultraviolet transparent sheet material sealed to the bottom wall of the cylinder to form a non-leaking multi-assay plate well.

2 Claims, 4 Drawing Sheets

ULTRAVIOLET RADIATION TRANSPARENT MULTI-ASSAY PLATES

FIELD OF INVENTION

This invention generally relates to ultraviolet radiation ("mid-UV") transparent multi-assay plates which are transparent in the UV region of about 200 to 300 nanometers. More particularly, this invention comprises a unique multi-assay plate with special mid-UV transparent well bottoms that will accommodate liquids without leaking, and that will permit an accurate mid-UV light absorbance measurement of liquid being analyzed. Multi-assay plates with 8×12 arrays of wells are commonly referred to as microplates.

BACKGROUND OF THE INVENTION

A variety of techniques and devices are commercially available for the detection and measurement of substances present in fluid or other translucent samples by determining the light absorbance of the sample. However, commercially available devices are limited in that they cannot suitably determine mid-UV absorbance of samples where the wavelength of the UV light is less than 300 nanometers. This limitation in commercial devices is due to the fact that commercial multi-assay plate devices do not have inexpensive mid-UV transparent multi-assay plates having well bottoms that will allow mid-UV light to pass vertically through the hole in the top of the multi-assay plate cylinders, through the sample, and thereafter pass unobstructed out through the well bottoms of the multi-assay plate mid on to the photodetector/detector board. Expensive UV-transparent multi-assay plates made of quartz are available but the cost is relatively great at about $1000 for a 96-well multi-assay plate made of quartz.

The present invention incorporates by reference the "Background of the Invention" for U.S. Pat. Nos. 4,968,148 and 5,112,134. As discussed in U.S. Pat. Nos. 4,968,148 and 5,112,134, the prior art has many problems and limitations. Although the vertical beam absorbance reader, taught in U.S. Pat. Nos. 4,968,148 and 5,112,134, solves or diminishes these problems and limitations, it has been discovered that mid-UV absorbance in multi-assay plates can be obscured because the inexpensive prior art devices made of polymeric materials devices are not designed for mid-UV light. Specifically, the prior devices have non-UV transparent multi-assay plates that prevent an accurate measurement of the UV absorbance of the sample under analysis. Mid-UV transparent multi-assay plates can be made of quartz but such devices are expensive and are not amenable to routine use.

SUMMARY AND OBJECTS OF THE INVENTION

It is the primary objective of this invention to provide an improved method of using the inventions of U.S. Pat. Nos. 4,968,148 and 5,112,134. More particularly, the present invention comprises a unique multi-assay plate having a plurality of well bottoms made of mid-UV material transparent in the mid-UV region of the electromagnetic spectrum of about 200 to 300 nanometers. These unique multi-assay plate well bottoms allow mid-UV light to pass from the multi-assay plate to the photodetector/detector board. This plurality of inventive well bottoms results in a more accurate measurement of solutions spectrophotometrically using mid-UV light. These multi-assay plates are particularly advantageous in that they are suitable for single use and avoid contamination problems associated with prior art UV transparent multi-assay plates.

The present invention comprises a plurality of multi-assay plate wells, each well comprising a cylinder with one end sealed with a mid-UV transparent polymer. The cylinder may be made of material non-transparent in the mid-UV. Attached to the bottom of multi-assay plate cylinders is a mid-UV transparent material that forms a well bottom that, in combination with the walls of the cylinder, will hold a liquid sample without leaking. An objective of the multi-assay plate of the present invention is to accommodate sample liquids without leaking. Another objective of the present invention is to provide a mid-UV transparent bottom for a multi-assay plate well that is hydrophilic, non-binding proteins, and has a high resistance to reacting with organic solvents.

A further objective of the present invention is to modify standard polystyrene multi-assay plates so that they can be used for mid-UV applications. Polystyrene is a material non-transparent in the mid-UV. A standard multi-assay plate is comprised of 96 multi-assay plate wells, each well having a hole at their top to accept a sample liquid and a polystyrene bottom to hold the liquid without leaking. However, the non-UV transparent nature of the polystyrene bottoms of standard multi-assay plate wells prevents them from being used in mid-UV applications. The present invention eliminates the non-UV transparent bottom of standard multi-assay plate wells and incorporates a mid-UV transparent material so that UV light can be used to analyze sample liquids.

A further objective of the present invention is a multi-assay plate design that will provide a low background optical density effect. Another objective of the present invention is a multi-assay plate design that will provide accurate repeatability of background absorbance for each multi-assay plate well in a multi-assay plate so that constant background absorbance can be systematically removed from the measurement result. Another objective of the present invention is an extended thermal range so that the measurement of absorption can be performed for an assay without changing the assay to another vessel.

DESCRIPTION OF THE PREFERRED EMBODIMENT

While the invention will be described in connection with certain preferred embodiments, it will be understood that the description does not limit the invention to these particular embodiments. In fact, it is to be understood that all alternatives, modifications and equivalents are included and are protected, consistent with the spirit and scope of the inventions as defined by the appended claims.

Figure 1:
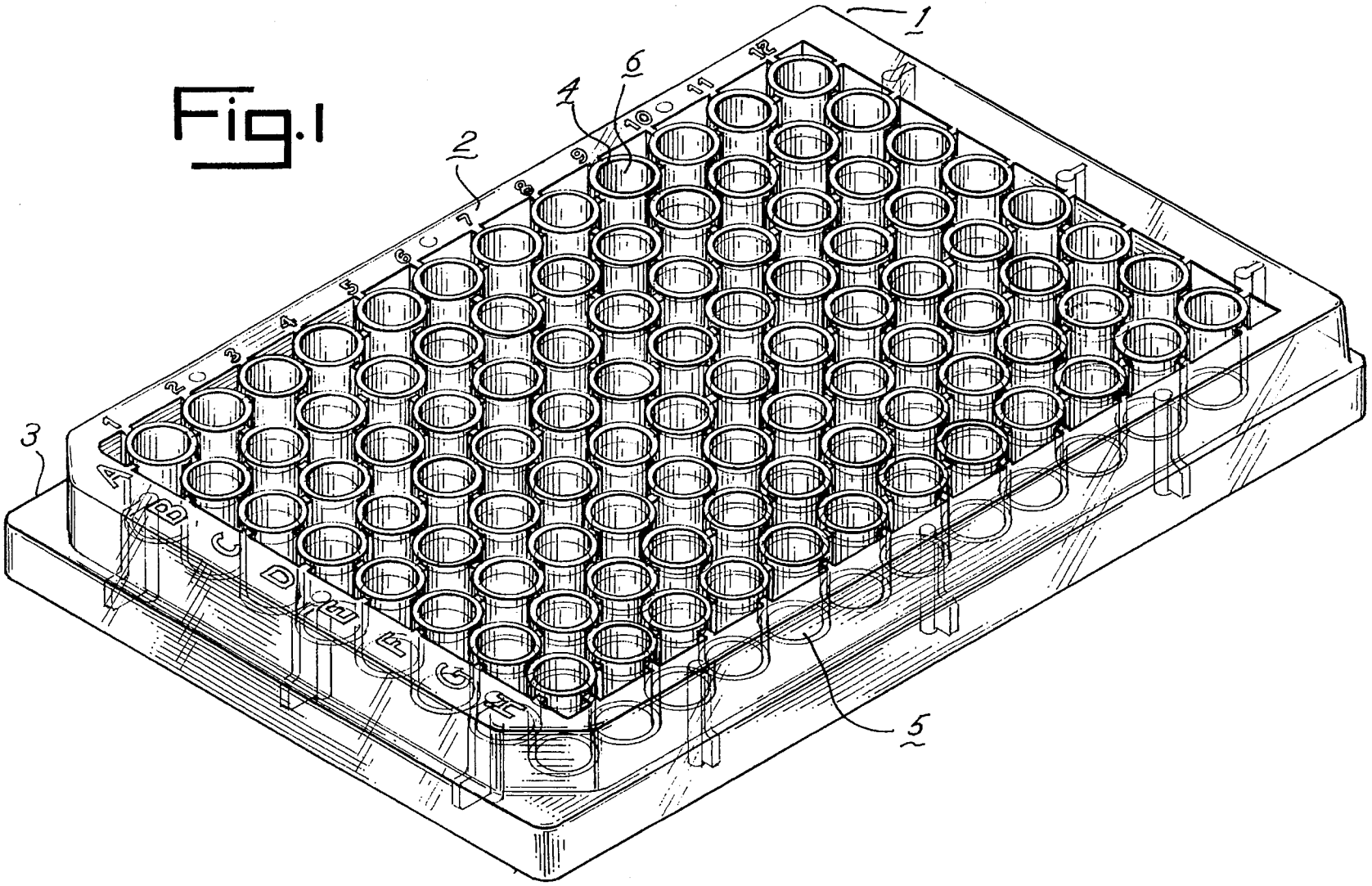
FIG. 1 is a top perspective drawing of the device of the present invention.

FIG. 1 shows the multi-assay plate 1 of the present invention. This multi-assay plate 1 has a frame 2 mounted on a base 3 and cylinders 4 are mounted in the frame. The bottom of the cylinders are covered with an essentially mid-UV transparent material 5. The open-ends of the cylinders 4 are shown as 6. Such multi-assay plates made out of polystyrene are standard in the industry, except according to the present invention the cylinder or well bottom is made of a material essentially transparent in the mid-UV region.

Figure 3:
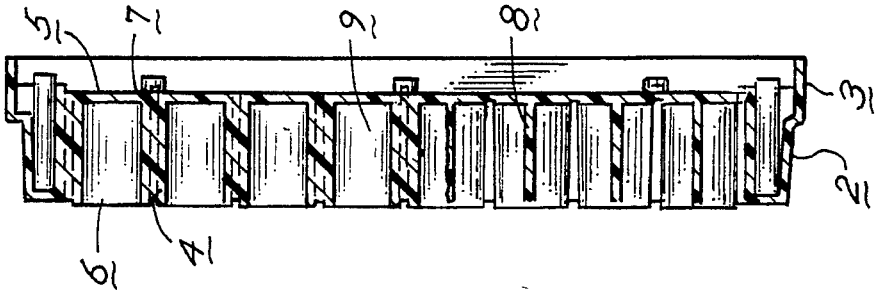
FIG. 3 is a sectional side drawing, taken along 3—3' of FIG. 2, of a column of multi-assay plate wells of the preferred embodiment of the present invention.
Figure 2:
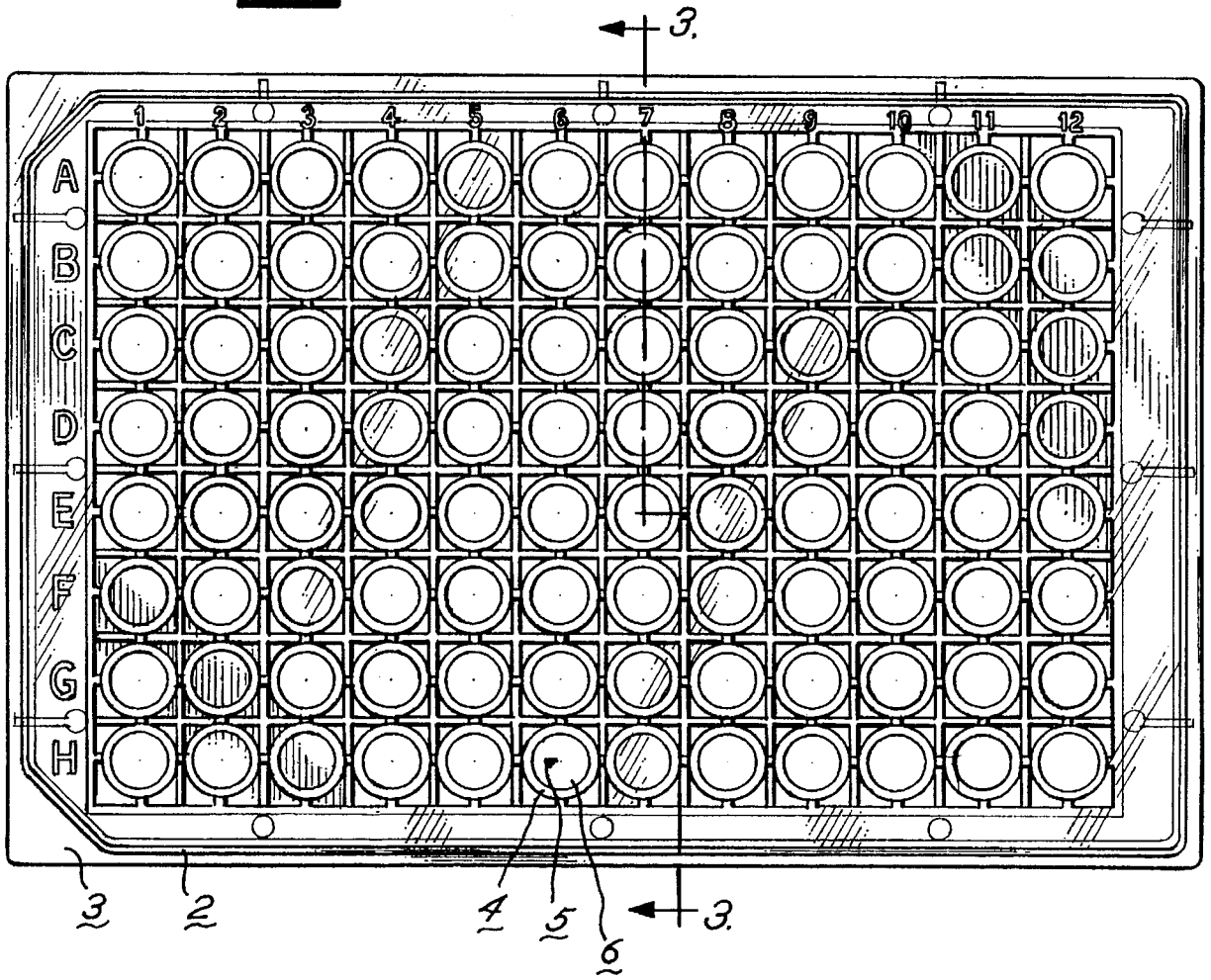
FIG. 2 is a top plan view of the device of FIG. 1.
Figure 4:
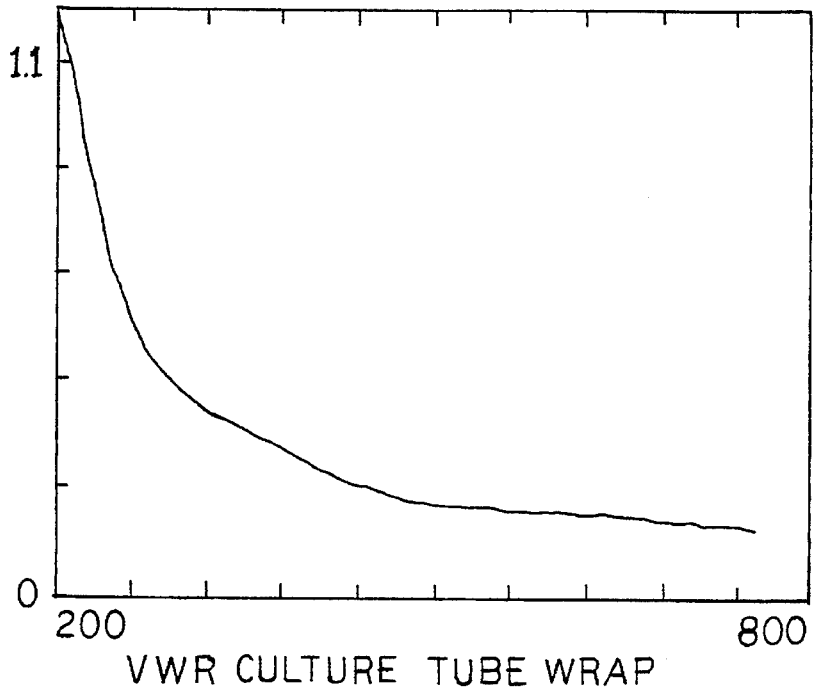
FIGS. 4 through 7 are graphs of background optical density absorbance measurements for various mid-UV transparent materials to show that these materials are indeed mid-UV transparent materials, with UV-light absorption low background. Especially important is the fact that the UV-transparent material 5 is transparent in the mid-UV region of about 200 to 300 nanometers. The materials identified in FIGS. 4–7 are, respectively, clear wrapper of VWR™ Culture Test Tubes, Saran™ Wrap made by Dow Chemical Co., Glad™ Sandwich Bags (i.e., polyethylene), Glad™ Cling Wrap (i.e., polyethylene), and 4-methylpentene-1 based polyolefin sold by Mitsui Petrochemical Industries, under the trademark TPX as compared to other materials.
Figure 5:
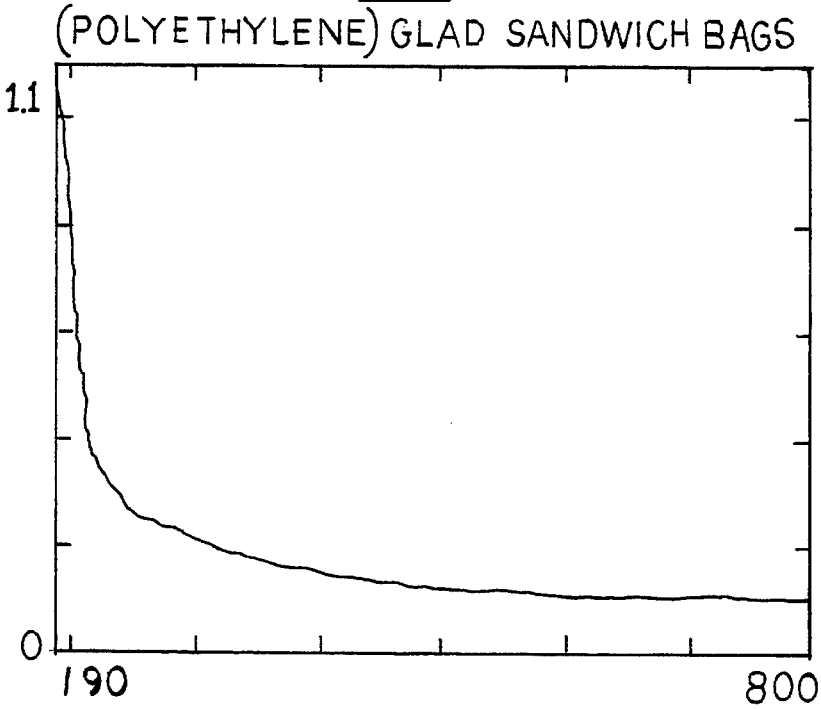
Figure 6:
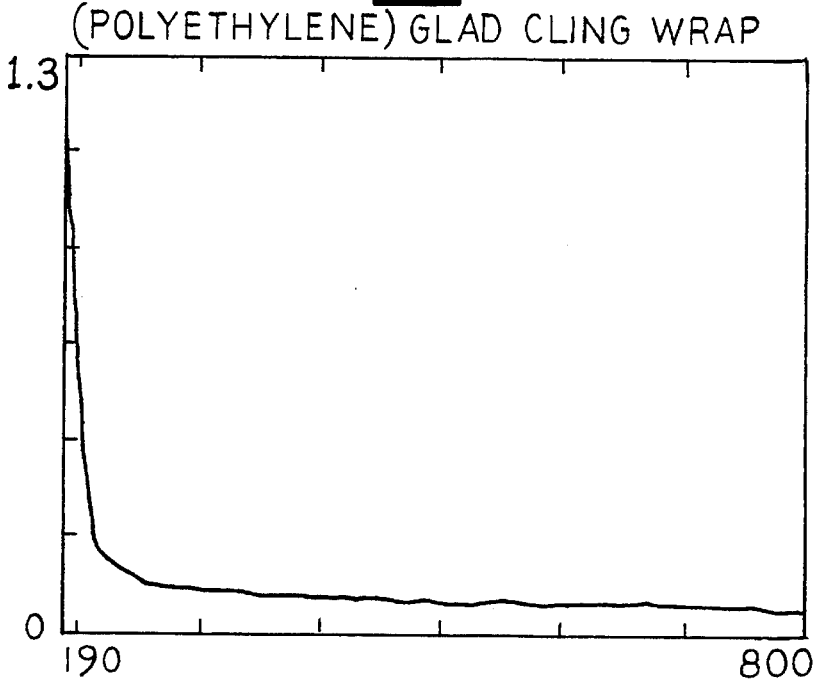

FIG. 2 is a top view of the multi-assay plate and FIG. 3 is a sectional view along 3—3' illustrating the cylinders 4, the well bottoms 5 made of mid-UV transparent material and the opening 6 for introducing samples into cylinder or wells. Support members are part of the integrally molded multi-assay plate.

Mid-UV transparent well bottoms 5 can be placed in the multi-assay plate wells formed by the cylinders 4 in a sealing fashion so the liquid to be analyzed will not leak out of the thus formed multi-assay plate wells 9. An adhesive material 7, e.g. RTV™ silicone rubber can be used to glue the circumference of the mid-UV transparent well bottoms 5 to the inside walls of the cylinders 4. Alternatively, the mid-UV transparent well bottoms 5 can be sonically welded to the walls of the bottom of the multi-assay plate cylinders 4. Those skilled in the an will recognize means for sealing plastic components together. A particularly advantageous way of sealing thin polymeric well-bottom material to cylinder walls polymeric cylinders 4 is to employ the structure taught in U.S. Pat. Nos. 4,948,442 and 5,047,215. One embodiment of the instant invention may be obtained by substituting a thin sheet of, mid-UV-transparent, polymeric material for the structure given as "filter sheet, 22," shown in FIG. 1 of either U.S. Pat. Nos. 4,948,442 or 5,047,215. Thus, for the instant invention, the thin mid-UV-transparent, polymeric material is sandwiched between the structure given as "culture tray 20" and the structure given as "harvester tray 24." The resulting structure then is assembled and bonded as indicated in U.S. Pat. No. 4,948,442 or 5,047,215. The methods of bonding the instant invention are the same as the various methods given in U.S. Pat. Nos. 4,948,442 and 5,047,215, which are incorporated herein by reference. The improvement of the instant invention is that "filter sheet 22" of the U.S. Pat. Nos. 4,948,442 and 5,047,215 is neither transparent in the mid-UV, nor is it able to retain liquids without leaking.

During use, the sample liquid to be analyzed is poured through the holes 6 and is contained in the wells 9 formed by walls of the multi-assay plate cylinders 4 and mid-UV transparent well bottoms 5. Mid-UV radiation can then be radiated through holes 15 and the mid-UV radiation that is not absorbed by the sample liquid radiates through mid-UV transparent well bottoms 5.

Sample liquids that can be analyzed using the present invention include any mid-UV absorbing material, such as a protein, polypeptide, or a polynucleotide (e.g., RNA or DNA).

A total of ninety-six multi-assay plate wells 9 can be used as in a standard multi-assay plate 1 (i.e., eight rows and twelve columns of multi-assay plate wells 9).

Figure 7:
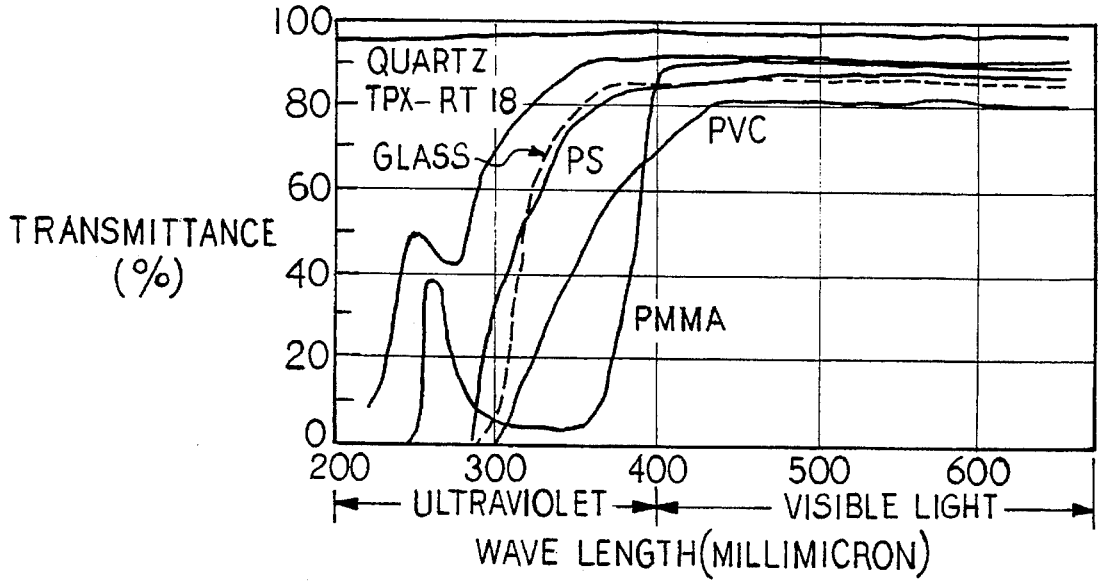

As noted above, FIGS. 3 through 7 show the mid-UV transparent properties of materials that can be used as mid-UV transparent well bottoms 5 in the present invention. The absorption spectrum of FIGS. 3 through 6 are for very thin polymeric material of a thickness less than 100 micron. The comparative absorption spectra shown in FIG. 7 are for thick materials of equivalent thickness of about 1 millimeter. As shown in FIG. 7 of the thick materials, only quartz has greater than 60% light transmission. Quartz, however, suffers from the severe disadvantage of being very expensive. Mid-UV transparent multi-assay plates having well bottoms 5 with greater than 60% light transmission in the mid-UV region of from 200 to 300 nanometers may be accomplished by suitably thinning the materials TPX-RT-18 and PMMA, (polymethyl-methacrylate) prior to attaching them to the bottoms of cylinders 4. Alternatively, the quartz material may be fused to the polymeric cylinders 4 to fabricate a mixed structure of polymeric cylinders and a flat quartz well bottoms 5. Of the four mid-UV transparent materials, the 4-methyl-pentene polymer sold under the trademark TPX is preferred. The material has superior strength and resistance to stretching compared to the other materials, and is the most preferred material of choice for the present invention.

Generally, it is desirable for the mid-UV-transparent multi-assay plates also to be transparent in the near-UV regions of the electromagnetic spectrum, of 300 to 400 nanometers of the electromagnetic spectrum, as well as in the visible, from 400 to 750 nanometers, and the near-infrared (near-IR) regions of from 750 to 1100 nanometers. Thus, the general embodiment of the invention has well bottoms 5 that are transparent in the entire region of from 300 nanometers to 1100 nanometers with an optical density of generally less than 0.4. The preferred embodiment of the invention has at least 60% light transmission in the entire region of from 300 nanometers to 1100 nanometers (that is, less than 0.222 OD).

The specifications for a multi-assay plate having suitable mid-UV transparent well bottoms 5 in the preferred embodiment of the present invention is as follows.

Format: A standard multi-assay plate of 96 multi-assay plate wells (8 multi-assay plate wells in a column and a total of 12 columns)

Material: 4-methyl-pentene-1 polymer (TPX)

Background OD: less than 0.4 OD (250 nm to 750 nm) maximum, lower background OD (of less than 0.222) is desirable Well variation in Background OD: plus or minus 0.020 OD maximum between wells plus or minus 0.010 OD typical between wells Temperature: 15° to 45° C. with no optical degradation 15° to 70° C. with no dimensional deformation Bottom shape: A flat bottom where the 4-methylpentene-1 polymer is fused to the bottom of the cylinder wall.

Bottom thickness: 0.020 inches, plus or minus 0.001 inches maximum 0.015 inches, plus or minus 0.001 inches minimum Minimum Diameter: 0.18 inches Protein binding: Hydrophilic, non-binding Chemical resistance: High resistance to organic solvents

What is claimed is:

1. A mid-UV transparent microplate comprising a frame with a plurality of parallel cylinders fixed in the frame, each cylinder defining a microplate well having a top and bottom opening, the bottom opening of each cylinder being sealed without leaking for holding liquid to be analyzed, with a portion of a substantially mid-UV transparent sheet material having an optical density of less than 0.4 OD from 250 nm to 750 nm, the mid UV transparent sheet material being selected from the group consisting of polyethylene and4-methylpentene-1 based polymer, the UV transparent material being in the form of a single sheet which is bonded to the bottom of each well, the microplate being characterized by an optical density variation between microplate wells of about a maximum of 0.02 OD (250 nm to 750 nm), the maximum thickness of the bottom being about 0.020 inches and the minimum thickness being about 0.015 inches, a minimum diameter of the cylinder is about 0.18 inches, a high resistivity to organic solvents and a temperature range of 15° to 45° C., with no optical degradation and 15° to 70° C. with no dimensional deformation, whereby said microplate will permit an accurate mid-UV light absorbance measurement of the liquid being analyzed.

2. The multi-assay plate of claim 1 comprising eight rows and twelve columns of multi-assay plates for a total of ninety-six multi-assay plate wells.

* * * * *